United States Patent [19]

Trbovich

[11] 3,992,009

[45] Nov. 16, 1976

[54] AIR CUSHION GAME

[76] Inventor: Nicholas D. Trbovich, 28 Tanglewood Drive West, Orchard Park, N.Y. 14127

[22] Filed: Feb. 3, 1975

[21] Appl. No.: 546,719

[52] U.S. Cl. ..... 273/126 R
[51] Int. Cl.[2] ..... A63F 7/00
[58] Field of Search ..... 273/126 R, 126 A, 37, 273/86 D; 248/346

[56] References Cited

UNITED STATES PATENTS

| | | | |
|---|---|---|---|
| 1,987,000 | 1/1935 | Cahill | 273/37 |
| 2,260,716 | 10/1941 | Kotler | 273/126 R |
| 3,228,692 | 1/1966 | Brubaker | 273/126 R |
| 3,425,696 | 2/1969 | Dockum | 273/126 R |
| 3,722,888 | 3/1973 | Ducharme | 273/126 R |

*Primary Examiner*—Richard C. Pinkham
*Assistant Examiner*—T. Brown
*Attorney, Agent, or Firm*—Christel & Bean

[57] ABSTRACT

An air cushioned table which includes an air bed with a perforated surface to which air under pressure is supplied from below creating a multiplicity of closely spaced air jets upon which a game piece floats. Scoring areas are disposed at opposite ends of the air bed and may include one or more different types of scoring patterns applicable to game play. The game piece passes over the air bed with the frictional drag thereon being significantly lower than that of the scoring area towards which the game piece is urged. The air bed and scoring areas are supported by a frame and are bounded by gutter means and outside border a gutter for respectively receiving the game piece should it fall off the air bed or scoring area and for retaining the game piece on the table. The holes in the air bed may be located in various arrangements so as to impart various movement characteristics to a game piece passing thereover. In addition air escape grooves are provided in the air bed surface for releasing a portion of the air cushion supporting a game piece so that movement of the gamepiece is distorted which in turn increases the interest and challenge in playing the game.

12 Claims, 18 Drawing Figures

Fig. 3.
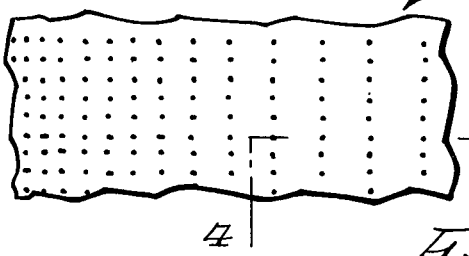
Fig. 4.
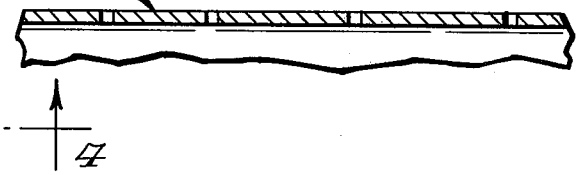
Fig. 5.
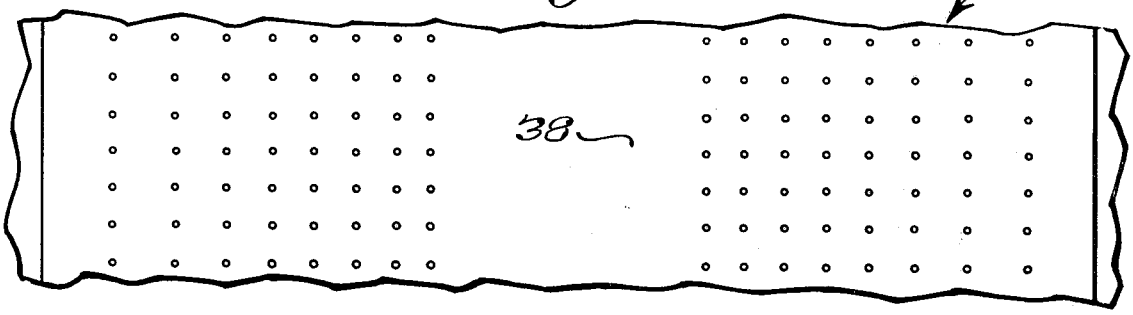
Fig. 6.
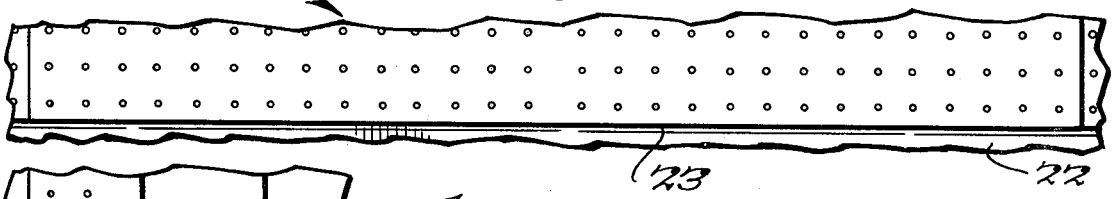
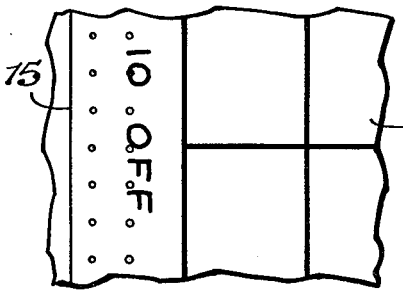
Fig. 7.
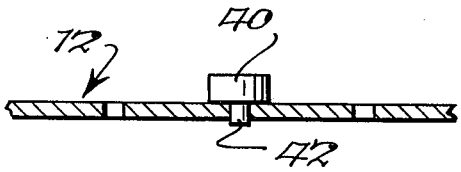
Fig. 8.

AIR CUSHION GAME

BACKGROUND OF THE INVENTION

The present invention relates to games of the type in which playing pieces are caused to be slid on a playing surface. The game comprising the present invention is an air cushioned device which includes relatively imperforate scoring areas disposed at the respective ends thereof and separated by a perforated air bed through which an air flow is forced.

The prior art has considered air cushioned table games in which a perforated playing surface includes manifold means on the underside thereof through which air is supplied to such playing surface. In this manner a game piece may be made to float over the air bed so as to minimize frictional contact therewith which can greatly reduce the force required to move the game piece.

A shortcoming of prior art games is the fact that the entire playing surface comprises an air bed on which the game piece rapidly moves but with which the player soon becomes accustomed so that the game soon provides less challenge to the player. In this regard, the present invention is directed to a game in which the players will not readily adapt to merely a familiar game at higher speed but will be challenged by the varying speeds and directions in which the game piece travels over the playing surface. Although the prior art has considered substantially uniform and continuous air bed game surfaces providing varying air-cushioned support to a game piece and correspondingly varying speeds thereto over such playing surface, these structures have necessitated complex means such as variable air valves and ducting to vary air pressure in various selected portions of the playing surface. In contrast the present invention provides varying speeds and directions to a game piece without such complex air pressure control means.

SUMMARY OF THE INVENTION

Accordingly, one object of the present invention is to provide a game surface which includes different or varying surface conditions and thereby different values of effective friction thereof at such different or varying sections of said surface.

A further object of the present invention is to provide a game table having at least one air cushioned section and one or more relatively imperforate sections located at various points on the playing surface.

Another object of the present invention is to provide a game having scoring areas which provide alternate ways of playing the game.

Still another object of the present invention is to provide means in which the air bed may be supplied with air by a fan means for selected durations of time only so that the game of the present invention is adaptable to commercial situations.

Yet another object of the present invention is to provide the game surface with various obstacles, grooves and hole patterns so as to challenge a player with respect to his anticipation of game piece movement.

In summary, the present invention provides a table type of game for use in a home or commercial establishment. The playing area includes an air bed supplied by a fan means with at least one relatively imperforate scoring area disposed adjacent to the air bed. The scoring areas are relatively imperforate in nature whereby a game piece floats over the air bed with relatively little frictional drag and rapidly comes to rest on a scoring area due to the loss of the air cushion which results in an increase in the frictional drag thereon. When multiple scoring areas are combined with the air bed they may or may not be identical to the other and may include different scoring patterns so that the players may select the type of scoring and hence the type of game play which they prefer. The air bed may further include various densities of air holes as well as air escape grooves in combination therewith so that the air cushion provides to the game piece is varied which in turn varies the travel of the game piece. In addition various obstacles and bumper rails may be provided so that additional challenge in considering play of the game piece is provided. The combined playing area comprising the air bed and scoring area as described hereinabove is surrounded by a depressed gutter means for receiving game pieces which slide or fall off of the playing area. The gutter means is in turn surrounded by a border for insuring that the game piece is retained within the gutter means and does not fall to the floor.

The foregoing and other objects, advantages and characterizing features of the present invention will become clearly apparent from the ensuing detailed description of an illustrative embodiment thereof taken together with the accompanying drawings wherein like reference characters denote like parts throughout the various views.

BRIEF DESCRIPTION OF THE DRAWINGS

FIG. 3 is a fragmentary, top plan view of the air bed of the present invention which includes variably spaced air holes therein;

FIG. 4 is a fragmentary, vertical section taken about on line 4—4 of FIG. 3;

FIG. 5 is a fragmentary, top plan view of an air bed included within the present invention which has a relatively imperforate barrier disposed transversely across its longitudinal midsection;

FIG. 6 is a fragmentary, top plan view of a playing area included in the present invention which has a narrow line of air holes immediately adjacent to the gutter means therein and wherein the lane or lanes of air holes extends along the entire longitudinal side edge of the playing area;

FIG. 7 is a fragmentary, top plan view of a scoring area of the present invention which includes a narrow border of air holes immediately adjacent to the gutter means disposed along the end edge;

FIG. 8 is a fragmentary, vertical view in section showing a bumper post disposed on the surface of an air bed;

DETAILED DESCRIPTION OF THE INVENTION

Figure 2:
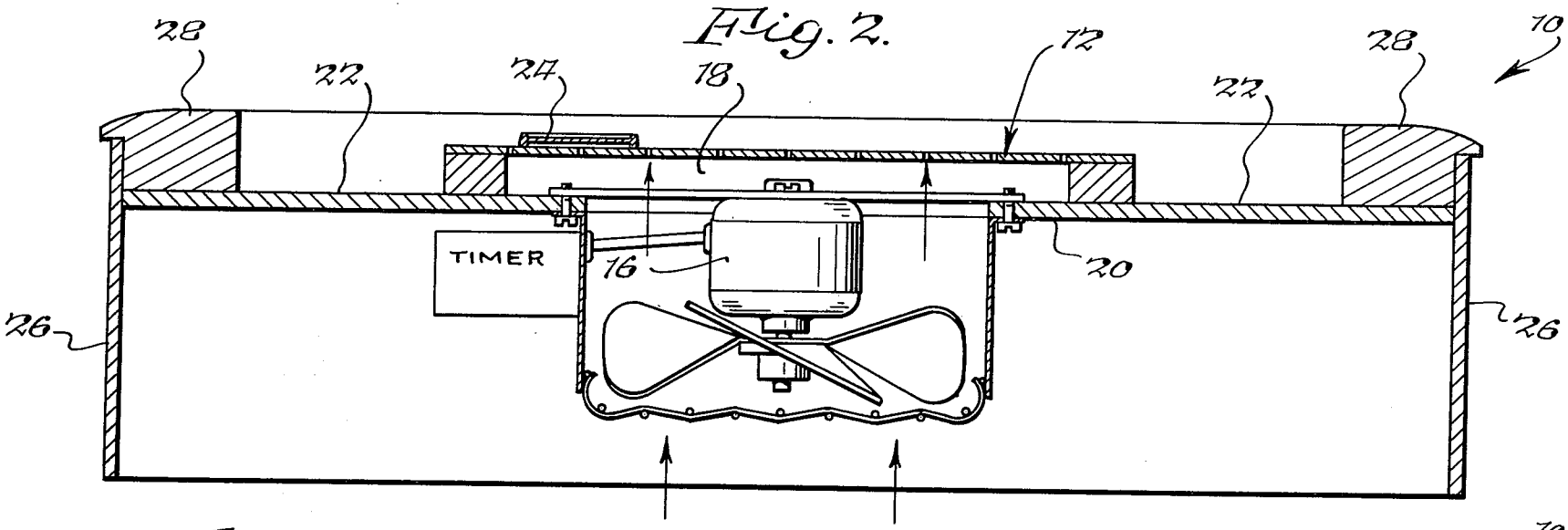
FIG. 2 is an enlarged transverse view in section taken about on line 2—2 of FIG. 1.
Figure 1:
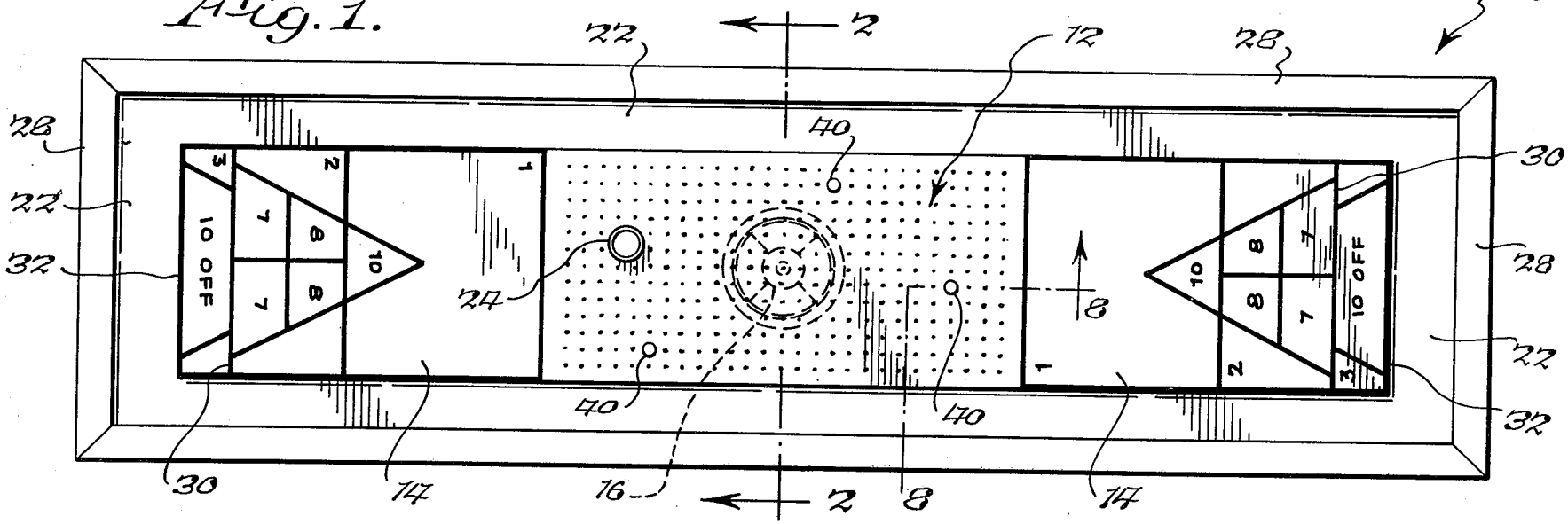
FIG. 1 is a top plan view of an air cushioned table game incorporating the present invention.

Referring now in detail to the illustrative embodiment depicted in the accompanying drawings, there is shown in FIG. 1 an air cushioned game generally indicated as 10 which includes a perforated air bed 12 and relatively imperforate scoring areas 14 located so as to be coplanar therewith as seen in FIG. 2 so that a playing area is formed by the combination of the air bed and said scoring areas. As viewed in FIG. 2, the air bed 12 includes a powered fan means 16 mounted therebeneath for urging air upwardly through the plurality of spaced perforations of the air bed as most clearly seen in FIG. 1. As further seen in FIG. 2, a manifold area is created at 18 as defined by the top surface of the air bed, the sidewalls and endwalls thereof, and the horizontal surface 20 on which the fan means 16 is mounted. By means of the manifold 18, which is closed at its sides and ends, air drawn towards the air bed can be more evenly distributed thereunderneath and forced upwardly through the various perforations.

As it is to be further understood from viewing FIGS. 1 and 2 together the aforesaid playing area is surrounded by a gutter means 22 for receiving a shaped game piece 24, (drawing defines a disc) to be more fully described hereinbelow, should it fall or slide off of the playing area. As further shown in FIG. 2, the game of this invention includes a frame means 26 for supporting the gutter means and playing area as well as a border frame means 28 which surrounds the outer peripheral edge of the gutter means. The border means merely serves to retain a game piece within the general confines of the shuffleboard game when a game piece for one reason or another should slide off the playing area into the gutter means. The border means therefore functions only to increase the convenience of retrieving game pieces and is not necessary for play of the game.

Figure 13:
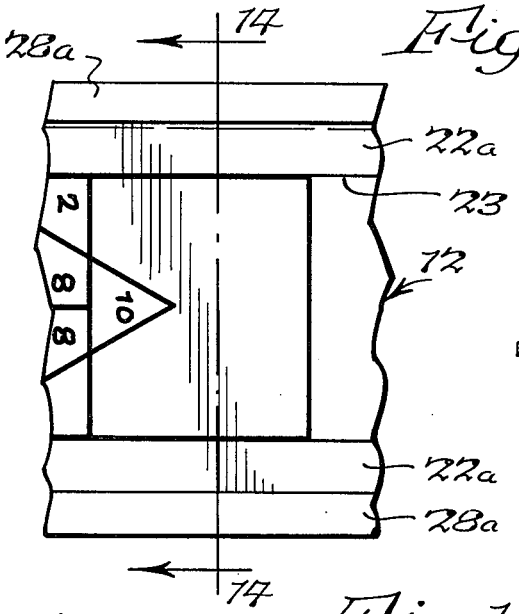
FIG. 13 is a fragmentary, top plan view of the playing area of the present invention wherein the gutter means is coplanar and adjacent the playing area.
Figure 14:
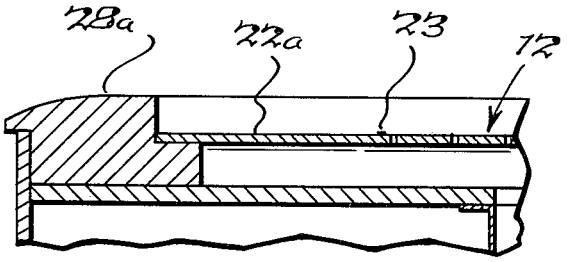
FIG. 14 is a fragmentary vertical view in section taken about line 14—14 of FIG. 13.
Figure 15:
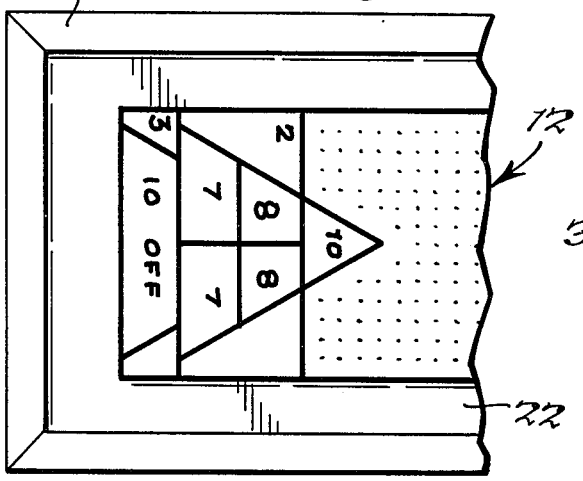
FIG. 15 is a fragmentary, top plan view of a scoring area and adjacent portion of an air bed wherein the air hole disposition of the air bed partially surrounds a portion of the scoring area.

An alternative to the gutter and border means shown in FIG. 2 is shown in FIGS. 13 and 14. As shown therein the gutter means **22*a* may simply comprise a lateral, coplanar extension of the playing area as formed by the air bed and scoring areas with a line 23 being provided to distinguish the playing area from the gutter area 22*a*. As shown in FIG. 14, the line 23 is somewhat raised for illustrative purposes but in actual construction the line 23 would preferably be formed in the playing area-gutter surface so as to be coplanar therewith. The advantage of the embodiment shown in FIGS. 13 and 14 is that the modified border means 28*a* may be provided to support the gutter area and playing area which is entirely coplanar and which therefore avoids the additional cost of the gutter 22 configuration shown in FIG. 2**.

Figure 16:
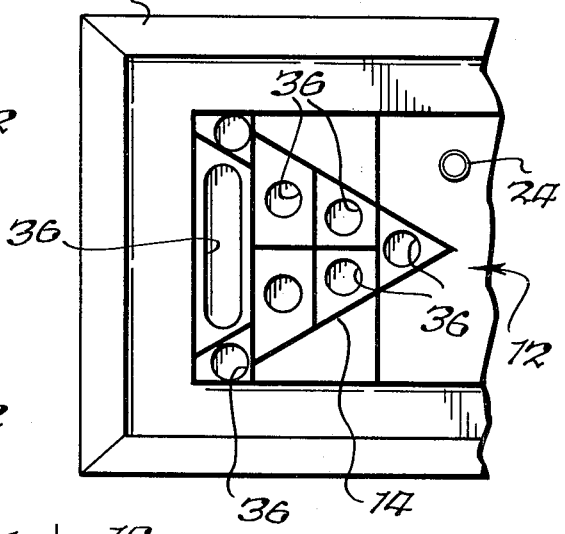
FIG. 16 is a fragmentary, top plan view of a scoring area contemplated within the present invention wherein recesses are provided in such scoring area for receiving a game piece.

Scoring area 14 of the present invention each include scoring means so that a player's score may be determined by a game piece coming to rest in the scoring area. As shown in FIG. 1, FIG. 7 and FIG. 16, various types of scoring means within the scoring areas may be utilized in conjunction with the air bed whereby each of the scoring areas in one table game may be substantially identical or may be different from one another depending upon any desired preferences when the game is assembled. For purposes of fully describing the present invention and all variations thereof, a brief description of the scoring means shown in FIGS. 1, 7 and 16 will be given.

It is anticipated that the game of this invention may be scored by using either one of the two patterns shown (but is not limited to) in FIG. 1 which facilitate competitive play. One of the scoring patterns, well known in the prior art shuffleboard games, comprises a plurality of rectangular shapes shown as including the numbers 1, 2 and 3. The rectangular shapes extend transversely across the scoring area and are of different longitudinal lengths, the first rectangle having a greater length with the rectangles disposed relatively closer to the end of the scoring area having progressively shorter longitudinal lengths. A second scoring pattern, also known in the prior art, comprises a triangular shape having a base edge 30 spaced parallel from the end edge 32 which is nonadjacent to the air bed. In addition, a trapezoidal shape is disposed between and is partially formed by the base edge 30 of each triangular shape and the end edge 32.

As further shown in FIG. 7, the scoring patterns in FIG. 1 could be modified to include a plurality of air holes in the surface of the scoring area wherein the air holes are disposed transversely across the playing area immediately adjacent to the end edge 15 thereof. Necessarily the air holes disposed adjacent to end edges 15 are in communication with air intake manifold 18 whereby a player seeking to place a game piece in the portion of the scoring pattern indicated as 3 which is generally imperforate in nature takes the change of overshooting this area by the game piece coming into contact with the air cushioning effect of the air holes in FIG. 7 and picking up speed so as to fall off the end of the playing area.

Still another alternative type of scoring means is shown in FIG. 16 which could be substituted for the scoring means as illustrated in FIG. 1. As shown in FIG. 16, a plurality of recesses 36 are formed in the surface of the scoring area 14 and include diameters or outer dimensions sufficiently large to receive a puck or game piece 24 as it passes over such scoring area. It is considered obvious to one skilled in the art that such recesses 36 could be arranged in a multitude of combinations and arrangements with corresponding scorepoints attributable thereto and therefore FIG. 16 is presented merely as an exemplary arrangement of such recesses 36.

It is further anticipated that the several perforations or air holes generally included within the air bed section of the game of the present invention can be arranged in various manners so as to provide increased interest and challenge to a player of the game. As shown in FIGS. 3 and 4, the air holes may be disproportionately spaced from one another so as to vary the degree of air cushioned support provided to a game piece. As shown in FIG. 3, the holes in the right hand portion thereof are relatively spaced far apart while the holes in the left hand portion are spaced relatively close together. As can be more fully appreciated from the sectional view given in FIG. 4, a game piece passing over the holes spaced relatively far apart would not be supported to the degree that it would be when passing over the closely spaced holes and therefore incurs relatively more frictional drag with respect to the air bed surface over the holes spaced more far apart while being subjected to less frictional drag with respect to the playing surface when passing over the firmer air cushion provided by the closely spaced holes.

One further possible application of the concept described with respect to FIGS. 3 and 4 is shown in FIG. 5. As shown in FIG. 5 the air bed includes a relatively imperforate portion at its longitudinal midsection 38 with air holes extending from the imperforate midsection toward each end of the air bed. As shown further in FIG. 5, the air holes therein are spaced relatively far apart at each leading edge of the air bed area and are spaced relatively close together at those portions adjacent to the relatively imperforate midsection 38. In this manner, a game piece passing longitudinally down the playing area in either direction as shown in FIG. 5, would encounter some frictional drag over the relatively spaced apart holes, would pick up speed due to the reduced frictional drag over the relatively closely spaced holes and then would encounter substantial frictional drag and reduction in speed over the imperforate midsection 38. After passing over the midsection 38 the game piece would experience a marked reduction in deceleration and thereby given an apparent increase in speed over the adjacent closely spaced holes and then would experience a subsequent reduction in speed as increaased frictional drag is encountered over the relatively more spaced apart holes. As can be easily appreciated, the rapid variation in the deceleration rate gives the appearance of the game piece first slowing down and then speeding up then greatly slowing down then speeding up and them again slowing down could be quite challenging to a player of the present game. It is also within the concept of the exemplary illustration shown in FIG. 5 that other relatively imperforate areas could be provided within the air bed means so as to provide the possibility of numerous combinations of relatively imperforate portions, portions having air holes spaced relatively far apart from one another, and portions having air holes being spaced relatively close to one another.

FIG. 6 is yet another arrangement employing the concept of the present invention of incorporating air holes into relatively imperforate playing surfaces. As shown in FIG. 6, the side edge 23 of the playing area, the latter comprising both the air bed means and scoring areas, includes a lane of air holes disposed along the surface thereof immediately adjacent to the side edge 23. By this arrangement, a player could be subjected to the difficulties of shooting a game piece over a centralized playing surface such as shown in FIG. 5 or he could "take his chances" and shoot the game piece along the marginal edge 23 while assuming the chance that the game piece could fall over the marginal edge 23 into the gutter means 22. In view of FIG. 5, the advantage to a player using the holes or path denoted by the holes in FIG. 6 is that the game piece will be subjected to a uniform air cushioned surface over which to travel, thereby avoiding the various conditions that a game piece encounters with respect to FIG. 5.

In regard to the possibility of varying the difficulty or challenge of shooting a game piece over the central air bed means such as shown in FIG. 5 or FIG. 1, it is further contemplated that additional obstacles such as bumper posts could be provided as shown by the exemplary arrangement thereof in FIG. 1. Obviously, the arrangement of such bumper posts is limited only by the imagination of one assembling the game. An added feature of this particular game is that the post portion 42 of the bumper post is formed to have an appropriate diameter for slip-fitting within an air hole as shown specifically in FIG. 8. In this manner, it would be possible for the ultimate user of the game to rearrange the bumper posts by utilizing any of the air holes provided in the playing surface so as to vary the conditions of the game play to that desired by the users thereof.

Figure 17:
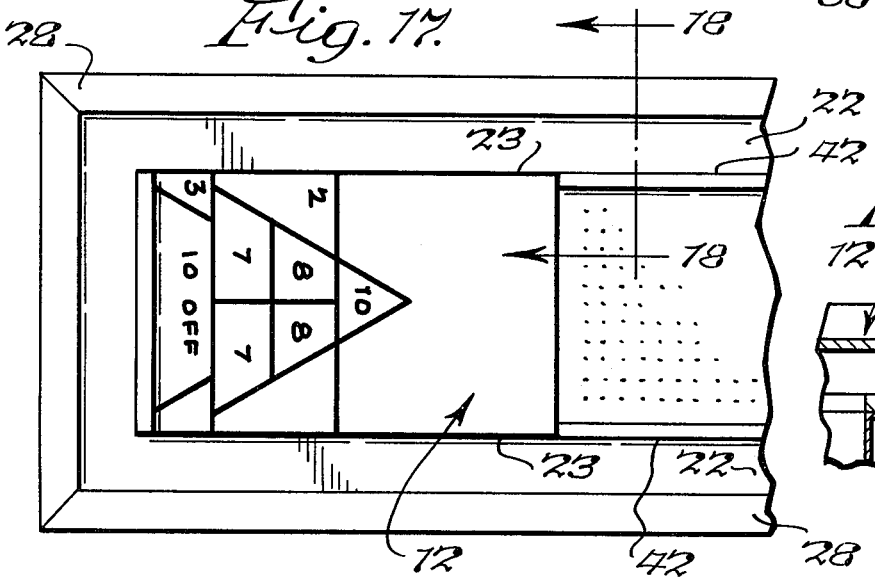
FIG. 17 is a fragmentary, top plan view of a scoring area and portion of an air bed including upstanding bumper rails along the end edge of the scoring area and along the side edges of the air bed.
Figure 18:
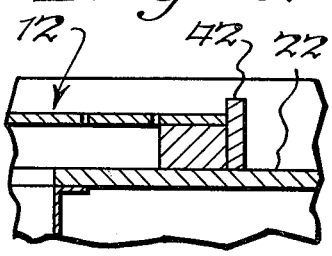
FIG. 18 is a fragmentary, vertical view in section of an upstanding bumper rail as taken about on 18—18 of FIG. 17.

Another feature of the present invention resides in the combination of upstanding bumper strips 42 being provided in combination with the playing surface of the present invention. As shown in FIGS. 17 and 18 the bumper strip 42 could be placed along a limited portion of the side edge 23 of the playing surface or for that matter along the entire length thereof. As shown in FIG. 18 a game piece passing diagonally across the playing surface could be rebounded off of the bumper strip 42 as a condition of game play or in conjunction with the game play to be further discussed hereinbelow.

Figure 9:
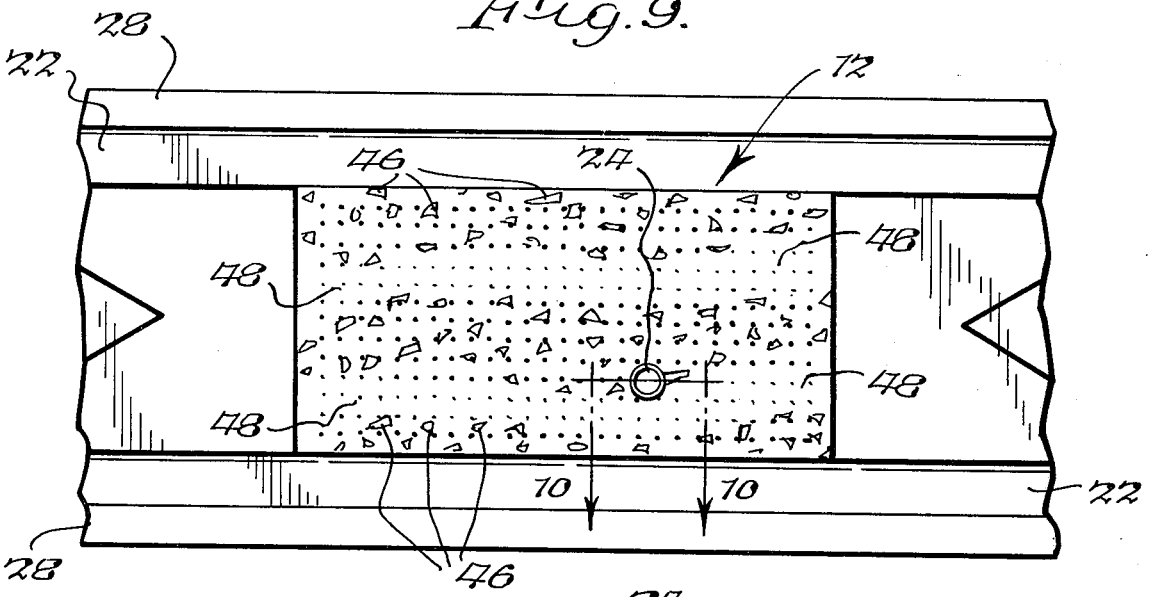
FIG. 9 is a fragmentary, top plan view showing an air bed having a plurality of air escape grooves in combination with air holes wherein the air escape grooves are so arranged as to provide selected longitudinal lanes across the air bed which would not subject the game piece to the effect of such air escape grooves.
Figure 10:
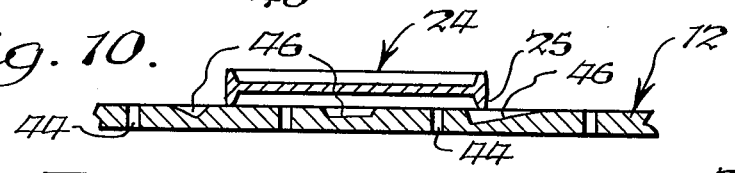
FIG. 10 is a fragmentary vertical sectional view taken about on line 10—10 of FIG. 9 showing an air escape groove and its disposition with respect to a skirted game piece passing thereover.

Another important feature of the present invention is illustrated in FIGS. 9 and 10. In FIG. 10, a portion of the playing surface is shown including a plurality of typical air holes 44 and air escape grooves 46 which are formed in the upper surface of the playing area. As further shown in FIG. 10, a game piece 24 is shown in section including a downwardly depending skirt 25 which extends about the perimeter of the game piece. Absent the effect of the air escape grooves 46, the game piece 24 is supported by an air cushion which is substantially enhanced by the placement of skirt 25 for preventing lateral dissipation of such air cushion which is provided by the plurality of air holes 44. However, as the skirt portion 25 of a game piece passes over an air escape groove 46 having a playing surface dimension greater than the thickness of skirt 25, additional space is provided for the air cushion trapped beneath the undersurface of a game piece to escape. It has been found desirable however that the air escape grooves 46 have an opening in the surface of the air bed means which is greater in size than the thickness of skirt 25 so that an efficient passage exists for bleeding off the air cushion from underneath the game piece 24. It has been further found that air escape grooves having openings equal to or less than the thickness or skirt 25 are not as effective. When a game piece 24 passes over an escape groove as shown in FIG. 10, with resultant bleeding of the air cushion, a certain degree of dipping or turbulence is imparted to the game piece which necessarily results in distorted movement of the game piece over the playing surface which therefore adds an additional factor of unpredictability to the play of the game. In this regard, one potential arrangement or utilization of the air escape grooves 46 is shown in FIG. 9. As shown therein, the air escape grooves are disposed over the air bed means with the exception of specific alleys or lanes 48 which do not include air escape grooves. Therefore, a player may try to shoot the game piece or puck down one of the alleys or lanes 48 and thereby avoid subjecting the game piece to the effect of the air escape grooves. However, the player would have to consider the desirability of where he wishes to place the game piece on the opposite end of the playing surface to the desirability of passing the game piece over the air bed without subjecting it to such air escape grooves.

Figure 11:
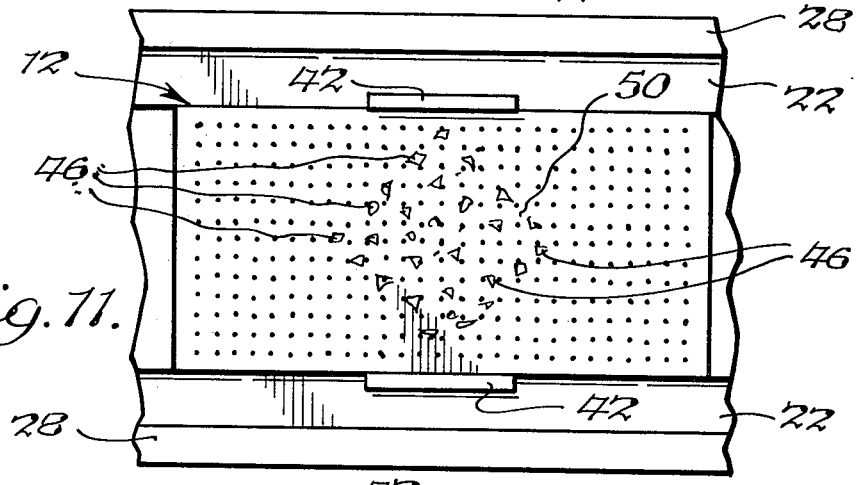
FIG. 11 is a fragmentary, top plan view of an air bed including a plurality of air escape grooves in combination with air holes in the midportion of the air bed and wherein upstanding bumper strips are provided along the side edges of the midportion of the air bed.
Figure 12:
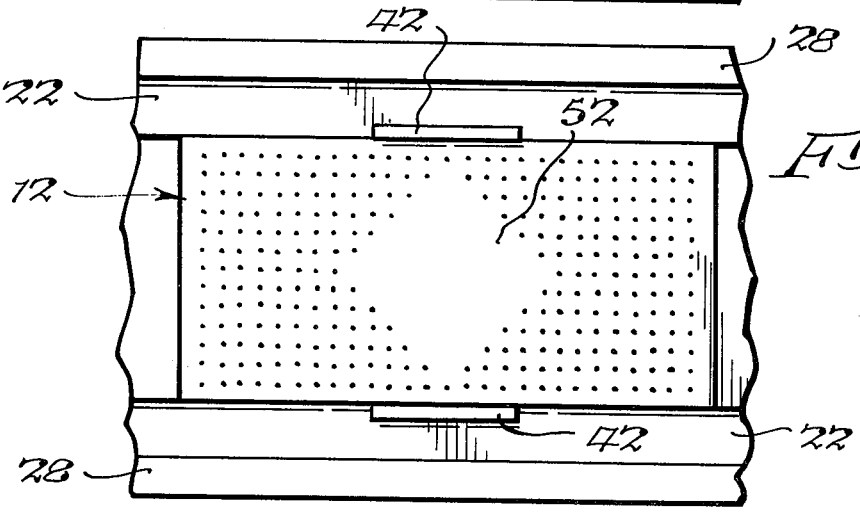
FIG. 12 is a fragmentary, top plan view of an air bed having a relatively imperforate midsection wherein upstanding bumper rails are provided along the side edges of the longitudinal midsection of the air bed.

Another potential use or arrangement of the air escape grooves 46 is to be seen in FIGS. 11 and 12. As shown, the midportion 50 of the air bed could be a diamond shape and include a plurality of air holes and air escape grooves 46 which would present a substantial factor of unpredictability to a player urging a game piece thereover as described hereinabove. In addition, bumper rails 42 of limited longitudinal length, as also described hereinabove, could be placed adjacent to the midportion of the air bed on the marginal edges thereof. In this manner, a player wishing to avoid the difficulty of the air hole-air escape groove section 50 could angle the game piece against bumper strip 42 so as to avoid the difficulty of area 50.

Similarly, as shown in FIG. 12, a mid portion 52 of the air bed could be made or formed relatively imperforate in nature while including bumper rails 42 adjacent thereto along the marginal edges so that a player wishing to shoot the game piece down the middle of the playing area would be subjected to the combination of air holes and relatively imperforate area 52. As in FIG. 11, the player could, as an alternative, angle the game piece against the bumper rails 42 so that the game piece would rebound thereoff down towards the far end of the game table and thereby avoid the difficulty resulting from inclusion of area 52 in the middle of the air bed.

In playing the air cushioned shuffleboard game contemplated in the present invention, opposing players or teams of players would be at opposite ends of the playing area as shown in FIG. 1 and the powered fan means 16 would be energized to provide an air flow through the perforations of the air bed 12, and any perforations as might exist in the scoring areas as shown in FIGS. 6 and 7. Upon choosing one of the aforesaid scoring patterns, a player would urge a game piece typically shown as 24 in FIG. 1 from one end of the playing area towards the other end in an attempt to place the game piece on that portion of the scoring pattern yielding the highest score. One of the primary features of the present invention is the fact that a sliding game piece will experience minimal frictional drag as it passes over portions including air holes while encountering a substantially increased frictional drag as it rides over the various imperforate areas. It is to be further appreciated that a player in sliding the game piece over the length of the playing surface must allow for frictional drag of the game piece over both his end of the table and the far end of the table and any intermediate imperforate sections while encountering minimum friction over the air hole portions. In addition, a player must consider the affect of any air escape grooves which might be present and the possibility of utilizing various paths of travel for the game piece, subject to any obstacles or disadvantages therein. In this manner, a player is challenged to anticipate the combined effect of the substantially varying frictional drags so as to place the game piece on the desired portion of a scoring pattern.

As would be obvious to one skilled in the art, the powered fan means 16 may be provided with a timing control means so that in a commercial environment the fan and necessarily the operation of the air bed can be operated for selected durations of time as would be commensurate with other games subject to such commercial use.

From the foregoing it is apparent that the objects of the present invention have been fully accomplished. As a result of this invention a new type of game is provided which substantially varies from other table game arrangements having a uniform frictional surface for a game piece. By means of the present invention, a player's skill and judgement is substantially challenged which results in increased interest and enjoyment during play of the game presently disclosed.

I claim:

1. An air cushioned game comprising in combination, an air bed means, said air bed means including a powered air source means, an upper, substantially horizontal surface and holes in at least a portion of said surface, said air source means discharging air upwardly through said holes in said surface of said air bed means, at least one scoring area being substantially coplanar with said air bed means so that a playing area is formed by said air bed means and said scoring area, said playing area including imperforate portions, at least one game piece having a shape, area and weight such that it floats upon at least a portion of said air bed means when said air source means is activated and is capable of moving over said air bed means generally without touching it, but wherein said game piece frictionally slides over said imperforate portions of said playing area in substantial contact therewith so that the translational movement of said game piece is retarded, and scoring means in said scoring area so that a player's score may be determined by said game piece coming to rest in said scoring area.

2. An air cushioned game as set forth in claim 1 wherein said air bed means and scoring area have respective side edges with gutter means being disposed adjacent thereto.

3. An air cushioned game as set forth in claim 2 wherein said gutter means is disposed below the surface of said air bed means and scoring area for receiving said game piece should it slide off of said playing area.

4. An air cushioned game as set forth in claim 3 wherein said air bed means and scoring area are rectangular in top plan view and of equal widths so that said respective side edges thereof are in substantial alignment.

5. An air cushioned game as set forth in claim 2 including frame means for supporting said playing area and said gutter means and further including border means, said border means being also supported by said frame means and extending substantially around the perimeter of said playing area to limit movement of said game piece off of said playing area and said gutter means.

6. An air cushioned game as set forth in claim 2 in which said scoring area includes at least one scoring pattern and wherein said pattern comprises a plurality of rectangular shapes extending transversely across said scoring area and being of different longitudinal lengths.

7. An air cushioned game as set forth in claim 2 in which said scoring area includes at least one scoring pattern wherein said pattern comprises a triangular shape having a base edge spaced parallel to the end edge of said scoring area non-adjacent to said air bed and a trapezoidal shape disposed between said base edge of said triangular shape and said scoring area end edge non-adjacent to said air bed.

8. An air cushioned game set forth in claim 2 wherein the side edges of said air bed and scoring area are in substantial alignment and portions of said playing area immediately adjacent to said sides edges include air holes along the length thereof.

9. An air cushioned game as set forth in claim 2 wherein said scoring area includes an end edge disposed transversely to said side edges thereof and non-adjacent to said air bed means, said scoring area including air holes in the surface thereof immediately adjacent to said scoring area end edge.

10. An air cushioned game as set forth in claim 2 in which said scoring area includes at least one recess in the surface thereof for receiving said game pieces.

11. An air cushioned game as set forth in claim 1 including frame means for supporting said playing area and further including border means, said border means being also supported by said frame means and extending substantially around the perimeter of said playing area to limit movement of said game piece off of said playing area.

12. An air cushioned game as set forth in claim 1 wherein said air bed means includes holes disproportionately spaced apart from one another.

* * * * *